US006840970B2

(12) United States Patent
Schwahn et al.

(10) Patent No.: US 6,840,970 B2
(45) Date of Patent: Jan. 11, 2005

(54) FUEL ADDITIVE COMPOSITIONS FOR FUELS FOR INTERNAL COMBUSTION ENGINES WITH IMPROVED VISCOSITY PROPERTIES AND GOOD IVD PERFORMANCE

(75) Inventors: Harald Schwahn, Wiesloch (DE); Dietmar Posselt, Heidelberg (DE)

(73) Assignee: BASF Aktiengesellschaft, Ludwigshafen (DE)

( * ) Notice: Subject to any disclaimer, the term of this patent is extended or adjusted under 35 U.S.C. 154(b) by 0 days.

(21) Appl. No.: 10/257,979

(22) PCT Filed: May 4, 2001

(86) PCT No.: PCT/EP01/05039

§ 371 (c)(1),
(2), (4) Date: Oct. 29, 2002

(87) PCT Pub. No.: WO01/85874

PCT Pub. Date: Nov. 15, 2001

(65) Prior Publication Data

US 2003/0140552 A1 Jul. 31, 2003

(30) Foreign Application Priority Data

May 5, 2000 (DE) ..... 100 21 936

(51) Int. Cl.[7] ..... C10L 1/18; C10L 1/22

(52) U.S. Cl. ..... 44/443; 44/412; 44/432; 44/433; 44/434

(58) Field of Search ..... 44/412, 388, 432, 44/433, 434, 443

(56) References Cited

U.S. PATENT DOCUMENTS 5,006,130 A 4/1991 Aiello et al.

6,579,329 B1 * 6/2003 Thomas et al. ..... 44/388

FOREIGN PATENT DOCUMENTS

| | | |
|---|---|---|
| EP | 0 310 875 | 4/1989 |
| EP | 0 356 725 | 3/1990 |
| EP | 0 374 461 | 6/1990 |
| EP | 0 376 578 | 7/1990 |
| EP | 0 460 957 | 12/1991 |
| EP | 0 548 617 | 6/1993 |
| EP | 0 569 228 | 11/1993 |
| EP | 0 587 250 | 3/1994 |
| EP | 0 634 472 | 1/1995 |
| EP | 0 704 519 | 4/1996 |
| EP | 0 752 461 | 1/1997 |
| WO | 91 13949 | 9/1991 |
| WO | 92 02601 | 2/1992 |
| WO | 94 21754 | 9/1994 |
| WO | 98 12284 | 3/1998 |

OTHER PUBLICATIONS

M Rossenbeck: "Additive fuer kraftstoffe" Katalysatoren, Tenside und Mineraloeladditive, pp. 223–229 1978.

* cited by examiner

*Primary Examiner*—Cephia D. Toomer
(74) *Attorney, Agent, or Firm*—Oblon, Spivak, McClelland, Maier & Neustadt, P.C.

(57) ABSTRACT

The invention relates to fuel additive compositions for internal combustion engines and to fuels that contain the corresponding additives for internal combustion engines. The inventive fuel additive compositions for internal combustion engines have an excellent performance in keeping the inlet system clean and improved viscosity properties, especially at low temperatures.

16 Claims, No Drawings

FUEL ADDITIVE COMPOSITIONS FOR FUELS FOR INTERNAL COMBUSTION ENGINES WITH IMPROVED VISCOSITY PROPERTIES AND GOOD IVD PERFORMANCE

The present invention relates to gasoline fuel additive compositions and fuels containing said additive compositions and intended for gasoline engines, the novel gasoline fuel additive packets having improved viscosity properties, especially at low temperatures, in addition to very good performance in keeping the intake system clean.

DESCRIPTION OF THE BACKGROUND

Carburetors and intake systems of gasoline engines as well as injection systems for fuel metering are increasingly being contaminated with impurities which are caused by dust particles from the air, and combustion hydrocarbon residues from the combustion chamber and the crank case vent gases passed into the carburetor.

These residues shift the air/fuel ratio during idling and in the lower part-load range so the mixture becomes leaner, the combustion becomes more incomplete and in turn the proportions of uncombusted or partly combusted hydrocarbons in the exhaust gas become larger and the gasoline consumption increases.

It is known that for avoiding these disadvantages, fuel additives are used for keeping valves and carburetors or intake systems of gasoline engines clean (cf. for example. M. Rossenbeck in Katalysatoren, Tenside, Mineral öladditive, Editors J. Falbe, U. Hasserodt, page 223, G. Thieme Verlag, Stuttgart 1978).

A distinction is now made between two generations depending on the mode of action as well as on the preferred place of action of such detergent additives.

The first additive generation could only prevent the formation of deposits in the intake system but could not remove deposits already present, whereas the modern additives of the second generation can do both (keep-clean and clean-up effect) and can do so in particular owing to their excellent thermal stability in zones of relatively high temperature, i.e. in the intake valves. Such detergents, which may originate from a large number of classes of chemical substances, for example polyalkeneamines, polyetheramines, polybutene Mannich bases or polybutene-succinimides, are generally used in combination with carrier oils and in some cases further additive components, e.g. corrosion inhibitors and demulsifiers. The carrier oils perform a solvent or wash function in combination with the detergents. Carrier oils are as a rule high-boiling, viscous, heat-stable liquids which coat the hot metal surface and thus prevent the formation or deposition of impurities on the metal surface.

Such formulations of detergents with carrier oils can be classified in principle as follows (depending on the type of carrier oils or carrier oil):

a) mineral-oil based (i.e. only mineral oil-based (mineral) carrier oils are used)
b) fully synthetic (i.e. only synthetic carrier oils are used) or, to a minor extent,
c) semisynthetic (i.e. mixtures of mineral oil-based and synthetic carrier oils are used).

It is known from the prior art that additive formulations thus described are used in gasoline fuels. It is true in general that fully synthetic additive packets have better keep-clean properties than mineral oil-based ones. It is also generally true that such fully synthetic additive packets have lower viscosities, especially at lower temperatures, than mineral oil-based formulations. Fully synthetic detergent additive packets to date thus have substantial advantages since, in addition to having good keep-clean properties with respect to the intake system, they can be more readily handled and processed, especially at relatively low temperatures.

In the classes consisting of the pure mineral oil-based and semisynthetic formulations, there is a need for optimization compared with the abovementioned fully synthetic additive packets.

SUMMARY OF THE INVENTION

It is an object of the present invention to provide semisynthetic fuel additive packets for gasoline fuels, which have both improved viscosity properties and very good keep-clean effects in the intake system.

We have found that, according to the invention, this object is achieved and that formulations for gasoline fuels which have very good properties both with respect to keeping the intake system clean and with respect to their low-temperature viscosity can be provided by the preparation of defined mixtures of mineral oil-based and synthetic carrier oils in combination with detergent additives.

DETAILED DESCRIPTION OF THE PREFERRED EMBODIMENTS

Surprisingly, such novel semisynthetic additive formulations showed very good performance with respect to their keep-clean properties on the one hand and moreover surprisingly have substantially lower viscosities at relatively low temperatures. Lower viscosities in the case of additive formulations in turn means advantages in the processing since less solvent has to be used for establishing the desired viscosity.

The present invention therefore first relates to fuel additive compositions which contain a) at least one detergent additive,
b) a carrier oil mixture comprising
   i) at least one synthetic carrier oil and
   ii) at least one mineral carrier oil, and
c) if required, further conventional fuel additive components.

Preferred fuel additive compositions are those whose mineral carrier oil component has a viscosity of about from 250 to not more than about 410, in particular from 350 to not more than 410, $mm^2/s$, determined at +20° C. according to DIN 51562, part 1.

Further fuel additive compositions preferred according to the invention are those whose synthetic carrier oil component has a viscosity of from about 120 to about 270, in particular from about 140 to about 240, mm2/s, determined at +20° C. according to DIN 51562, part 1.

Particularly preferred fuel additive compositions contain a mineral carrier oil component and a synthetic carrier oil component in a weight ratio of from about 10:1 to about 1:10, in particular from about 5:1 to about 1:5, preferably from about 4:1 to about 1:4.

The weight ratio of detergent additive component to carrier oil component (sum of mineral and synthetic carrier oils) is from about 1:20 to 20:1, in particular from about 1:10 to 10:1, preferably from about 1:5 to about 5:1 or from about 2:3 to about 4:1.

For example, useful fuel additive compositions contain a) from about 10 to 80, for example from about 40 to 80, % by weight of detergent additive(s),
b) from about 20 to 90, for example from about 20 to 60, % by weight of carrier oil mixture and c) if required, from 0 to 30, for example from about 1 to 20, % by weight of further conventional fuel additive components.

Fuel additive compositions preferred according to the invention comprise, as the detergent additive component (component a), a detergent additive selected from polyalkenemonoamines, polyalkenepolyamines, polyetheramines and mixtures thereof. Examples of useful polyetheramines are poly-$C_2$–$C_6$-alkylene oxide amines and examples of polyalkeneamines are poly-$C_2$–$C_6$-alkeneamines, and functional derivatives thereof, in each case having a preferred Mn from about 150 to 5 000, preferably from about 500 to 2 000, in particular from about 700 to 1 500, g. In this context, amines include both monoamines and polyamines, preferably having up to 6 nitrogen atoms.

Polyalkenemonoamines or polyalkenepolyamines or functional derivatives thereof which can be used according to the invention are in particular poly-$C_2$–$C_6$-alkeneamines or functional derivatives thereof, for example based on polypropene, polybutene or polyisobutenes.

Examples of functional derivatives of the above additives are compounds which carry one or more polar substituents, in particular hydroxyl groups, for example in the amine moiety.

Preferred additives which can be used according to the invention are polyalkenemonoamines or polyalkenepolyamines based on polypropene or on highly reactive (i.e. having predominantly terminal double bonds—generally in the alpha- and beta-positions) or conventional (i.e. having predominantly middle double bonds) polybutene or polyisobutene having Mn of from 150 to 5 000, preferably from about 500 to 2 000, in particular from about 800 to 1 500, g.

Such additives based on highly reactive polyisobutene, which can be prepared from polyisobutene which may contain up to 20% by weight of n-butene units by hydroformylation and reductive amination with ammonia, monoamines or polyamines, such as dimethylaminopropylamine, ethylenediamine, diethylenetriamine, triethylenetetramine or tetraethylenepentamine, are disclosed in particular in EP-A-244 616 or EP-A-0 578 323.

If, in the preparation of the additive, polybutene or polyisobutene having predominantly middle double bonds (generally in the beta- and gamma-positions) is used as starting material the preparation by chlorination and subsequent amination or by oxidation of the double bond with air or ozone to give the carbonyl or carboxyl compound and subsequent amination under reductive (hydrogenating) conditions is possible. For the amination, the amines used here may be the same as those used above for the reductive amination of the hydroformylated highly reactive polyisobutene. Corresponding additives based on polypropene are described in particular in WO-A-94/24231.

Further preferred polyalkeneamines additives containing monoamino groups are the hydrogenation products of the reaction products of polyisobutenes having an average degree of polymerization P of from 5 to 100 with oxides of nitrogen or mixtures of oxides of nitrogen and oxygen, as described, in particular, in WO-A 97/03946.

Further preferred additives containing monoamine groups are the compounds obtainable by reaction with amines and subsequent dehydration and reduction of the aminoalcohols, as described, in particular, in DE-A 196 20 262.

Particularly useful detergent additives of the polyalkeneamine type are sold by BASF AG, Ludwigshafen, under the trade name Kerocom PIBA. These contain polyisobuteneamines dissolved in aliphatic $C_{10}$–$C_{14}$-hydrocarbons and can be used as such in the novel additive packets.

Examples of useful carrier oils or carrier oil liquids (component b) are combinations of mineral carrier oil or oils and synthetic carrier oil or oils, which are compatible with the additive or additives used and with the fuel.

Suitable mineral carrier oils which fulfill the above novel viscosity criterion are fractions obtained in mineral oil processing such as kerosene or naphtha, brightstock or base oils having viscosities such as, for example, from class SN 500–2000, but also aromatic hydrocarbons, paraffinic hydrocarbons and alkoxy alkanols. A fraction known as hydrocrack oil and obtained in the refining of mineral oil (vacuum distillation step with a boiling range of from about 360 to 500° C., obtainable from natural mineral oil catalytically hydrogenated and isomerized under high pressure and deparaffinized) can also be used. Mixtures of the abovementioned mineral carrier oils are also suitable.

Examples of synthetic carrier oils which can be used according to the invention and fulfill the above novel viscosity criterion are selected from polyolefins (poly)esters, (poly)alkoxylates, polyethers, aliphatic polyetheramines, alkylphenol-initiated polyethers, alkylphenol-initiated polyetheramines and carboxylic esters of long-chain alkanols.

Examples of suitable polyethers or polyetheramines are compounds which preferably contain polyoxy-$C_2$–$C_4$-alkylene groups and are obtainable by reaction of $C_2$–$C_{60}$-alkanols, $C_6$–$C_{30}$-alkanediols, mono- or di-$C_2$–$C_{30}$-alkylamines, $C_1$–$C_{30}$-alkylcyclohexanols or $C_1$–$C_{30}$-alkylphenols with from 1 to 30 mol of ethylene oxide and/or propylene oxide and/or butylene oxide per hydroxyl group or amino group and, in the case of the polyetheramines, by subsequent reductive amination with ammonia, monoamines or polyamines. Such products are described, in particular, in EP-A 310 875, EP-A-356 725, EP-A-700 985 and U.S. Pat. No. 4,877,416. For example, the polyetheramines used may be poly-$C_2$–$C_6$-alkylene oxide amines or alkanol derivatives thereof. Typical examples of these are tridecanol or isotridecanol butoxylates, isononylphenol butoxylates and polyisobutenol butoxylates and propoxylates and the corresponding reaction products with ammonia.

Examples of carboxylic esters of long-chain alkanols are in particular esters of mono-, di- or tricarboxylic acids with long-chain alkanols or polyols, in particular those having a minimum viscosity of 2 $mm^2/s$ at 100° C., as described, in particular, in DE-A-38 38 918. The mono-, di- or tricarboxylic acids which may be used are aliphatic or aromatic acids, and particularly suitable ester alcohols or ester polyols are long-chain members of, for example, 6 to 24 carbon atoms. Typical examples of the esters are adipates, phthalates, isophthalates, terephthalates and trimellitates of isooctanol, of isononanol, of isodecanol and of isotridecanol, e.g. di(n- or isotridecyl) phthalate.

Further suitable carrier oil systems are described, for example, in DE-A-38 26 608, DE-A-41 42 241, DE-A-43 09 074, EP-A-0 452 328 and EP-A-0 548 617, which are hereby expressly incorporated by reference.

Examples of particularly suitable synthetic carrier oils are alcohol-initiated polyethers having from about 5 to 35, for example from about 5 to 30, $C_3$–$C_6$-alkylene oxide units, for example selected from propylene oxide, n-butylene oxide and isobutylene oxide units, or mixtures thereof. Nonlimiting examples of suitable initiator alcohols are long-chain alkanols of phenols substituted by long-chain alkyl, the long-chain alkyl radical being in particular a straight-chain or branched $C_6$–$C_{18}$-alkyl radical, in particular $C_8$–$C_{15}$-alkyl radical. Preferred examples are tridecanol and nonylphenol.

An example of a composition preferred according to the invention, typically for a semisynthetic gasoline fuel additive packet, comprises:

a) from about 20 to 80, preferably from 40 to 80, % by weight of at least one polyisobuteneamine or a functional derivative thereof, b) from about 20 to 80, preferably from about 20 to 60, % by weight of a mixture of at least one synthetic carrier liquid, such as a polyether, for example composed of from about 10 to 35, e.g. from 15 to 30, $C_3$–$C_6$-alkylene oxide units, e.g. propylene oxide, n-butylene oxide and isobutylene oxide units or mixtures thereof, and at least one mineral oil-based carrier oil, the mixing ratio being from about 10:1 to 1:10.

In addition to the detergent additive main component (a) (polyetheramine and/or polyalkeneamine), one or more further detergent additives may be present, provided that the advantageous effects observed according to the invention are not adversely affected thereby. Examples of further useful detergent additives are those which have at least one hydrophobic hydrocarbon radical having a number average molecular weight (Mn) of from 85 to 20 000 and at least one polar group which is selected from the additive groups (ab) to (ag):

| | |
|---|---|
| (ab) | additives containing nitro groups, if necessary in combination with hydroxyl groups; |
| (ac) | additives containing hydroxyl groups in combination with mono- or polyamino groups, at least one nitrogen atom having basic properties; |
| (ad) | additives containing carboxyl groups or their alkali metal or alkaline earth metal salts; |
| (ae) | additives containing sulfo groups or their alkali metal or alkaline earth metal salts; |
| (af) | additives which contain groups derived from succinic anhydride, with hydroxyl and/or amino and/or amido and/or imido groups; and |
| (ag) | additives containing groups produced by Mannich reaction of alkylphenols with aldehydes and mono- or polyamines. |

The hydrophobic hydrocarbon radical in these detergent additives, which ensures sufficient solubility in the fuel, has a 45 number-average molecular weight (Mn) of from 85 to 20 000, in particular from 113 to 10 000, especially from 300 to 5 000.

Suitable typical hydrophobic hydrocarbon radicals, in particular in combination with the polar groups (ac), (af) and (ag), are the polypropenyl, polybutenyl and polyisobutenyl radicals, each having Mn of from 150 to 5 000, in particular from 500 to 2 500, especially from 700 to 2 250.

Additives (ab) containing nitro groups, if necessary in combination with hydroxyl groups, are preferably reaction products of polyisobutenes having an average degree of polymerization P of from 5 to 100 or from 10 to 100 with oxides of nitrogen or mixtures of oxides of nitrogen and oxygen, as described in particular in WO-A 96/03367 and in WO-A 96/03479. These reaction products are as a rule mixtures of pure nitro polyisobutanes (e.g. α,β-dinitropolyisobutane) and mixed hydroxynitropolyisobutanes (e.g. α-nitro-β-hydroxy-polyisobutane).

Additives (ac) containing hydroxyl groups in combination with mono- or polyamino groups are in particular reaction products of polyisobutene epoxides, obtainable from polyisobutene preferably having predominantly terminal double bonds and having an Mn of from 150 to 5 000, with ammonia or mono- or polyamines, as described in particular in EP-A 476 485.

Additives (ad) containing carboxyl groups or their alkali metal or alkaline earth metal salts are preferably copolymers of $C_2$–$C_{40}$-olefins with maleic anhydride, which have a total molar mass of from 500 to 20 000 and some or all of whose carboxyl groups have been converted into the alkali metal or alkaline earth metal salts and the remainder of the carboxyl groups have been reacted with alcohols or amines. Such additives are disclosed in particular in EP-A 307 815. Such additives serve mainly for preventing valve seat wear and, as described in WO-A 87/01126, can advantageously be used in combination with conventional fuel detergents, such as poly(iso)buteneamines or polyetheramines.

Additives (ae) containing sulfo groups or their alkali metal or alkaline earth metal salts are preferably alkali metal or alkaline earth metal salts of an alkyl sulfosuccinate, as described in particular in EP-A-639 632. Such additives serve mainly for preventing valve seat wear and can advantageously be used in combination with conventional fuel detergents, such as poly(iso)buteneamines or polyetheramines.

Additives (af) containing groups derived from succinic anhydride, with hydroxyl and/or amido and/or imido groups, are preferably corresponding derivatives of polyisobutenylsuccinic anhydride, which are obtainable by reacting conventional highly reactive polyisobutene having an Mn of from 150 to 5 000 with maleic anhydride by a thermal route or via the chlorinated polyisobutene. Of particular interest here are derivatives with aliphatic polyamines, such as ethylenediamine, diethylenetriamine, triethylenetetramine or tetraethylenepentamine. Such gasoline fuel additives are described in particular in U.S. Pat. No. 4,849,572.

Additives (ag) containing groups produced by Mannich reaction of substituted phenols with aldehydes and mono- or polyamines are preferably reaction products of polyisobutene-substituted phenols with formaldehyde and mono- or polyamines, such as ethylenediamine, diethylenetriamine, triethylenetetramine, tetraethylenepentamine or dimethylaminopropylamine. The polyisobutene-substituted phenols may originate from conventional or highly reactive polyisobutene having an Mn of from 150 to 5 000. Such polyisobutene Mannich bases are described in particular in EP-A 831 141.

Further detergent additives suitable according to the invention are described, for example, in the European patent applications EP-A-0 277 345, EP-A-0 356 725, EP-A-0 484 736, EP-A-0 539 821, EP-A-0 543 225, EP-A-0 548 617, EP-A-0 561 214, EP-A-0 567 810 and EP-A-0 568 873; and in the German patent applications DE-A-39 42 860, DE-A-43 09 074, DE-A-43 09 271, DE-A-43 13 088, DE-A-44 12 489, DE-A-044 25 834, DE-A-195 25 938, DE-A-196 06 845, DE-A-196 06 846, DE-A-196 15 404, DE-A-196 06 844, DE-A-196 16 569, DE-A-196 18 270 and DE-A-196 14 349.

For a more exact definition of the individual gasoline fuel additives mentioned, reference is made here expressly to the disclosures of the abovementioned prior art publications.

Further conventional additives (component (c)) are corrosion inhibitors, for example based on ammonium salts of organic carboxylic acids, which salts have a tendency to form films, on heterocyclic aromatics in the case of corrosion protection of nonferrous metals, dyes, antioxidants or stabilizers, for example based on amines, p-phenylenediamine, dicyclohexylamine or derivatives thereof, or on phenols, such as 2,4-di-tert-butylphenol or 3,5-di-tert-butyl-4-hydroxyphenyl-propionic acid, demulsifiers, antistatic agents, metallocenes such as ferrocene or methylcyclopentadienylmanganesetricarbonyl, further lubricity additives, such as specific fatty acids, alkenylsuccinic esters, bis(hydroxyalkyl) fatty amines or hydroxyacetamides, and markers. If necessary, amines too are added for reducing the pH of the fuels.

The novel fuel additive combinations, if necessary in combination with one or more of the abovementioned further fuel additives having the polar groups, and the other components mention are metered into the fuel and display their effect there. Components or additives may be added to the fuel individually or as a previously prepared concentrate (additive packet).

Suitable solvents or diluents (in the case of the provision of additive packets) are aliphatic and aromatic hydrocarbons, e.g. solvent naphtha or kerosene.

The novel fuel additive mixtures are added to the fuel, for example, in an amount of from 10 to 5 000, preferably from 20 to 1 500, ppm (mg/kg fuel).

The further fuel additives which may be used and which have the polar groups are added to the fuel usually in an amount of from 10 to 5 000 ppm, in particular from 50 to 1 000 ppm, and the other components and additives mentioned are added, if desired, in amounts customary for this purpose.

The fuel to which the novel fuel additive mixtures are added are not subject to any particular restrictions per se. It may be, for example, a gasoline fuel according to DIN EN 228. The fuel may be, for example, a gasoline fuel having an aromatics content of not more than 42, e.g. from 20 to 42, % by volume and a sulfur content of not more than 150 ppm, e.g. from 0.5 to 150 ppm.

The gasoline fuel may furthermore have an olefin content of not more than 21, e.g. from 6 to 21, % by volume.

The benzene content may be not more than 1.0, e.g. from 0.5 to 1.0, % by volume; the oxygen content may be, for example, from 0.1 to 2.7% by weight.

The content of alcohols and ethers in the gasoline fuel is usually relatively low. Typical maximum contents are 3% by volume for methanol, 5% by volume for ethanol, 10% by volume for isopropanol, 7% by volume for tert-butanol, 10% by volume for isobutanol and 15% by volume for ethers having 5 or more carbon atoms in the molecule.

The summer vapor pressure of the gasoline fuel is usually not more than 70, in particular 60, kPa (in each case at 37° C.).

The research octane number (RON) of the gasoline fuel is as a rule from 90 to 100. A conventional range for the corresponding motor octane number (MON) is from 80 to 90.

Such specifications are determined by conventional methods (DIN EN 228).

The nonlimiting examples below illustrate the invention.

PREPARATION EXAMPLE A (ACCORDING TO THE INVENTION)

A mixture of 50% by weight of a conventional detergent additive (about 50% by weight polyisobuteneamine having an Mn of 1 000; dissolved in n-paraffin mixture having a viscosity of <20 $mm^2/s$ at 20° C.; trade name Kerocom PIBA from BASF), 38% of a mineral base oil (viscosity at +20° C.: 407 $mm^2/s$) and 10% of a synthetic butylene oxide carrier (tridecanol etherified with butylene oxide units) (viscosity at +20° C.: 157 $mm^2/s$) is prepared.

PREPARATION EXAMPLE B (COMPARISON)

A mixture is prepared analogously to example A, except that the mineral carrier oil is replaced by a base oil not according to the invention and having a viscosity at +20° C. of 432 $mm^2/s$.

TEST EXAMPLE 1

Comparison of the Lower Temperature Viscosities

For examples A (according to the invention) and B (not according to the invention), low-temperature viscosities in $mm^2/s$ are determined (DIN 51562 part 1) at various temperatures. The results are summarized in Table 1 below.

TABLE 1

| Mixture | Viscosity at the stated temperature | | | |
|---|---|---|---|---|
| | +20° C. | −10° C. | −15° C. | −20° C. |
| A | 114 | 853 | 1401 | 3016 |
| B | 114 | 916 | 1568 | 3462 |

Surprisingly, a substantially smaller increase in viscosity with decreasing temperature is observed for the novel additive composition.

TEST EXAMPLE 2

Comparison of the IVD Performance

The testing of the IVD performance of the compositions according to Examples A and B was carried out in tests in a test bay with a Mercedes Benz M102E engine according to CEC F-05-A-93. The metering rate of the mixtures A and B were 700 mg/kg in each case. Commercial gasoline fuel according to EN 228 was used. The results are summarized in table 2 below.

TABLE 2

| Additive | Average intake valve deposits [mg] |
|---|---|
| None (base value) | 455 |
| Additive from Example A (according to the invention) | 4 |
| Additive from Example B (comparison) | 28 |

The novel composition surprisingly exhibits a clearly advantageous IVD performance.

PREPARATION EXAMPLE C (ACCORDING TO THE INVENTION)

A mixture of 60% by weight of conventional detergent additive (about 50% by weight of polyisobuteneamine having an Mn of 1 000; dissolved in n-paraffin mixture having a viscosity of <20 $mm^2/s$ at 20° C.; trade name Kerocom PIBA from BASF), 20% by weight of a base oil (viscosity at +20° C.: 407 $mm^2/s$) and 20% by weight of a propylene oxide carrier (tridecanol etherified with propylene oxide units) (viscosity at +20° C.: 166 $mm^2/s$) is prepared.

PREPARATION EXAMPLE D (COMPARISON)

Preparation example C is repeated, the mineral carrier oil being replaced by a base oil not according to the invention and having a viscosity at +20° C. of 432 $mm^2/s$.

PREPARATION EXAMPLE E (ACCORDING TO THE INVENTION)

A mixture of 60% by weight of a conventional detergent additive (about 50% by weight of polyisobuteneamine having an Mn of 1 000; dissolved in n-paraffin mixture having a viscosity of <20 $mm^2/s$ at 20° C.; trade name Kerocom PIBA from BASF), 20% by weight of a base oil (viscosity at +20° C.: 407 $mm^2/s$) and 20% by weight of a butylene oxide carrier (tridecanol etherified with butylene oxide units) (viscosity at +20° C.: 157 $mm^2/s$) is prepared.

PREPARATION EXAMPLE F (COMPARISON)

Preparation example E is repeated, the mineral carrier oil being replaced by a base oil not according to the invention and having a viscosity at +20° C. of 432 $mm^2/s$.

TEST EXAMPLE 3

For examples C, D, E and F low-temperature viscosities in $mm^2/s$ are determined (DIN 51562 part 1) at −20° C. The results are summarized in Table 3 below:

TABLE 3

| Mixture | Viscosity at the stated temperature | |
|---|---|---|
| | +20° C. | −20° C. |
| C | 74.4 | 1237 |
| D (comparison) | 74.7 | 1353 |
| E | 89.7 | 1496 |
| F (comparison) | 90.8 | 1655 |

Substantially higher viscosities at −20° C. are observed for the mixtures not according to the invention.

We claim:

1. A fuel additive composition, which compnses:

a) at least one detergent additive, b) a carrier oil mixture comprising:

i) at least one synthetic carrier oil selected from the group consisting of polyethers having a viscosity ranging from about 120 to about 270 $mm^2/s$, determined at +20° C. according to DIN 51562, part 1; and ii) at least one mineral carrier oil having a viscosity ranging from about 250 to about 410 $mm^2/s$, determined at +20° C. according to DIN 51562, part 1; and c) if required, further conventional fuel additive components.

2. A fuel additive composition as claimed in claim 1, wherein the mineral carrier oil component is a carrier oil selected from the group consisting of brightstock, base oils having viscosities from class S 500–2000, aromatic hydrocarbons, paraffinic hydrocarbons, alkoxyalkanols and hydrocrack oil and mixtures thereof.

3. A fuel additive composition as claimed in claim 1, wherein mineral carrier oil components and synthetic carrier oil components are present in a weight ratio ranging from about 10:1 to about 1:10.

4. A fuel additive composition as claimed in claim 1, wherein the detergent additive component comprises a detergent additive selected from the group consisting of polyalkenemonoamines, polyalkenepolyamines, polyetheramines and mixtures thereof.

5. A fuel additive composition as claimed in claim 4, wherein the detergent additive comprises a poly-$C_2$–$C_6$-alkeneamine or poly-$C_2$–$C_6$-alkylene oxide amine.

6. A fuel additive composition as claimed in claim 5, wherein the detergent additive comprises a poly-$C_2$–$C_6$-alkeneamine or poly-$C_2$–$C_6$-alkylene oxide amine having an Mn ranging from 150 to 5 000.

7. A fuel additive composition as claimed in claim 1, which comprises:

a) from about 10 to 80% by weight of detergent additive (s), b) from about 20 to 90% by weight of a carrier oil mixture, and c) if required, from 0 to 30% by weight of further convention fuel additive components.

8. A fuel composition, which comprises:

in addition to a main amount of a hydrocarbon fuel, an amount, which has detergent activity and reduces intake valve deposits, of an additive composition as claimed in claim 1.

9. A fuel composition as claimed in claim 8, wherein the additive composition is present in an amount ranging from about 10 to 5 000 mg/kg of fuel.

10. A method of reducing the intake valve deposits in internal combustion engines, which method comprises operating said engines with a fuel containing the fuel additive composition as claimed in claim 1.

11. A fuel additive composition as claimed in claim 3, wherein the weight ratio of mineral carrier oil component to synthetic carrier oil component ranges from about 5:1 to about 1:5.

12. A fuel additive composition as claimed in claim 1, wherein said weight ratio of detergent additive component to the entire carrier oil component ranges from about 1:20 to about 20:1.

13. A fuel additive composition as claimed in claim 12, wherein said weight ratio of detergent additive component to the entire carrier oil component ranges from about 1:10 to about 10:1.

14. A fuel additive composition as claimed in claim 13, wherein said weight ratio of detergent additive component to the entire carrier oil component ranges from about 1:5 to about 5:1.

15. A fuel additive composition as claimed in claim 1, wherein the polyether carrier oil is prepared by reacting $C_2$–$C_{60}$-alkanols, $C_2$–$C_{30}$-alkandiols, mono- or di-$C_2$–$C_{30}$-alkylamines, $C_1$–$C_{30}$-alkylcyclohexanols or $C_1$–$C_{30}$-alkylphenols with from 1 to 30 mole of ethylene oxide, propylene oxide or butylene oxide per hydroxyl group or amino group or combinations thereof.

16. A fuel additive concentrate comprising a fuel additive composition as defined in claim 1.

* * * * *